US006729171B2

(12) United States Patent
Ladousse et al.

(10) Patent No.: US 6,729,171 B2
(45) Date of Patent: May 4, 2004

(54) COLD FORMING BY ROLLING OF PARTS MADE OF PRESS SINTERED MATERIAL

(75) Inventors: Claude Ladousse, Chatenoy le Royal (FR); Michel Cretin, Mellecey (FR); Charles Marcon, Chagny (FR)

(73) Assignee: Escofier Technologie S.A.S., Chalon sur Saone (FR)

( * ) Notice: Subject to any disclaimer, the term of this patent is extended or adjusted under 35 U.S.C. 154(b) by 0 days.

(21) Appl. No.: 10/176,618

(22) Filed: Jun. 24, 2002

(65) Prior Publication Data

US 2003/0226386 A1 Dec. 11, 2003

(30) Foreign Application Priority Data

Jun. 6, 2002 (FR) ..... 02 06980

(51) Int. Cl.[7] ..... B21D 15/00
(52) U.S. Cl. ..... 72/108; 29/893.32
(58) Field of Search ..... 72/102, 108, 109, 72/88, 89, 105, 112, 121, 122, 123; 29/893.32

(56) References Cited

U.S. PATENT DOCUMENTS 3,874,049 A * 4/1975 Ferguson ..... 419/28
4,059,879 A * 11/1977 Chmura et al. ..... 384/513
4,111,031 A * 9/1978 Vennemeyer et al. ..... 72/359
4,708,912 A 11/1987 Huppmann
5,659,955 A 8/1997 Plamper
5,711,187 A 1/1998 Cole et al.
5,884,527 A 3/1999 Cole et al.
6,105,234 A * 8/2000 Kremsmair et al. ..... 29/521
6,151,941 A * 11/2000 Woolf et al. ..... 72/102
6,468,468 B1 * 10/2002 Neubing et al. ..... 419/38

FOREIGN PATENT DOCUMENTS

DE 3140189 4/1983

* cited by examiner

*Primary Examiner*—Ed Tolan
(74) *Attorney, Agent, or Firm*—Greenblum & Bernstein, P.L.C.

(57) ABSTRACT

Method of cold forming a blank made of press sintered material which includes moving at least one tool towards the blank and subjecting the blank to rolling under a roughly constant load for a number of passes until the at least one tool reaches a chosen position. At least one of, the chosen position, the roughly constant load, and the corresponding number of passes, is determined so as to control a surface densification and at least one dimension of the rolled blank.

35 Claims, 9 Drawing Sheets

COLD FORMING BY ROLLING OF PARTS MADE OF PRESS SINTERED MATERIAL

CROSS-REFERENCE TO RELATED APPLICATIONS

The present application claims priority under 35 U.S.C. §119 of French Patent Application No. FR 02/06980 filed on Jun. 6, 2002.

BACKGROUND OF THE INVENTION

1. Field of the Invention

The invention relates to the cold forming of parts from blanks, particularly metal blanks. It applies in particular to blanks made of press sintered material.

2. Discussion of Background Information

"Cold forming" is to be understood as meaning deformation of the metal of the blank at ambient temperature or in the semi-hot state (up to a temperature of 300 to 500° C. depending on the metal of the blank), i.e., below its melting point.

A distinction should be drawn between cold forming by revolution rolling ("rolling" for short), which uses rotary tools or the equivalent, as opposed to other methods of cold forming such as machining, drop forging, stamping or extension.

There are several configurations for forming by rolling:

external forming of the blank, using a tool, the blank being held in some other way, or alternatively using two or more tools distributed uniformly around the external periphery of the blank;

internal forming of a hollow blank, using at least one internal tool and at least one external tool, or an external support which turns with the blank.

Furthermore, the blank is often driven by the tool or tools, but can also be driven separately, in synchronism or otherwise.

Mastering the position of the tools with respect to the blank is a particularly tricky operation. Use is generally made of hydraulic (ram) or mechanical (screw-nut) position control. However, it has become apparent that the known control techniques were not always satisfactory, particularly in the case of blanks made of press sintered material, as will be seen.

SUMMARY OF THE INVENTION

The present invention improves the situation.

The invention thus provides for a method of cold forming by rolling a blank made of press sintered material. In the method, at least one tool of predetermined peripheral geometry is brought close to the blank, so that the tool can then be rolled over the blank, urging the one towards the other.

According to one aspect of the invention, this method comprises, after a phase (a) of approaching the blank, a penetration phase (b), with:

($b_n$) at least one phase of rolling under roughly constant load, as far as a chosen position, this load, the chosen position, and the corresponding number of passes being determined so as to control the surface densification and the dimensions of the rolled part.

According to another aspect of the invention, after a phase (a) of approaching the blank, a penetration phase (b) is provided, with:

($b_1$) at least one phase in which the rolling load increases, bounded by a maximum value of this rolling load.

The phase ($b_n$) of rolling under roughly constant load can then take place, as appropriate.

The invention also provides for a method of cold forming a blank made of press sintered material, comprising moving at least one tool towards the blank and subjecting the blank to rolling under a roughly constant load for a number of passes until the at least one tool reaches a chosen position, wherein at least one of, the chosen position, the roughly constant load, and the corresponding number of passes, is determined so as to control a surface densification and at least one dimension of the rolled blank.

The at least one tool may have a predetermined peripheral geometry. The method may further comprise rolling the at least one tool over the blank. The method may further comprise urging the at least one tool and the blank towards one another. Each of the chosen position, the roughly constant load, and the corresponding number of passes may be determined so as to control a surface densification and at least one dimension of the rolled blank. The method may further comprise controlling the roughly constant load. The method may further comprise, before the subjecting, rolling the blank with an increasing load. The method may further comprise, before the subjecting, rolling the blank with an increasing load up to a maximum value. The method may further comprise, before the subjecting, rolling the blank with an increasing load up to the roughly constant load. The method may further comprise, before the subjecting, rolling the blank with a controlled increasing load up to the roughly constant load. The method may further comprise, before the subjecting, rolling the blank with a controlled increasing load. The method may further comprise, before the subjecting, rolling the blank with an increasing load that is determined according to a critical law which tends to bring a load progression close to an experimentally determined permissible limit value that takes account of geometric and mechanical properties of the blank.

The subjecting may comprise maintaining the roughly constant load below a limit value defined with respect to a threshold at which the press sintered blank deteriorates. The subjecting may comprise maintaining the roughly constant load below a limit value defined with respect to a threshold at which the at least one tool deteriorates. The subjecting may comprise maintaining the roughly constant load at a value close enough to a limit value to avoid excessive work hardening while at the same time minimizing a rolling time.

The moving and the subjecting may be repeated after a direction of rotation of the at least one tool has been reversed. The method may further comprise subjecting the blank to finish rolling. The finish rolling may comprise maintaining the roughly constant relative positions of the blank and the at least one tool for a chosen length of time.

The at least one tool may comprise peripheral profile that is at least one of roughly circular and generally cylindrical. The blank may comprise a preformed part. The preformed part may comprise teeth. The preformed part may comprise a ring. The ring may comprise a bearing ring. The at least one tool may comprise teeth. The at least one tool may comprise a uniform external periphery.

The method may further comprise controlling the moving and the subjecting via a program. The moving and the subjecting may occur on a numerically controlled machine. The subjecting may comprise first subjecting the blank to rolling under a roughly constant load for a number of passes until the at least one tool reaches a first chosen position, and second subjecting the blank to rolling under a roughly constant load for a number of passes until the at least one tool reaches a second chosen position. The subjecting may comprise first subjecting the blank to rolling under a load for a number of passes until the at least one tool reaches a first chosen position, and second subjecting the blank to rolling under a roughly constant load for a number of passes until the at least one tool reaches a second chosen position.

The invention also provides for a method of cold forming a press sintered material part, comprising moving at least one tool towards the part and subjecting the part to controlled rolling under a roughly constant load for a number of passes until the at least one tool reaches a chosen position, wherein the chosen position, the roughly constant load, and the corresponding number of passes, is determined so as to control a surface densification and at least one dimension of the part being rolled.

The invention still further provides for a method of cold forming a press sintered material part, comprising moving at least one tool towards the part, subjecting the part to a first rolling under a first controlled load for a number of passes until the at least one tool reaches a first chosen position, and subjecting the part to a second rolling under a roughly constant second controlled load for a number of passes until the at least one tool reaches a second chosen position, wherein the first chosen position, the second chosen position, the roughly constant load, and the corresponding number of passes, is determined so as to control a surface densification and at least one dimension of the part being rolled.

BRIEF DESCRIPTION OF THE DRAWINGS

Other features and advantages of the invention will become apparent from examining the detailed description which follows, and the appended drawings in which.

Furthermore, Annex 1 expresses, in the form of a table, characteristics of the control of cold forming machines according to the invention.

DETAILED DESCRIPTION OF THE INVENTION

The detailed description hereafter, the annex or annexes, and the drawings contain, essentially, elements of a certain nature. They can be used therefore not only to allow a better understanding of the description, but also to contribute to defining the invention, as appropriate.

Cold forming makes it possible in particular to produce a very precise shape (forming proper) and/or to alter a surface finish, which is often known as roller burnishing or alternatively "superfinishing".

Conventionally, the blank is the thing which enters the forming machine, with or without preform, and the part is the thing which leaves it. The words "blank" and "part" will be used arbitrarily or together for the intermediate states inside the machine.

Detailed information on cold forming by revolution rolling, or rolling, can be found on the site www.escofier.com, on the pages "metier_procédé", and in the corresponding printed technical documentation.

The invention relates a priori to methods employing machines with variable distances between centers, with tools of roughly constant profile on their periphery, and working with "plunge feed", that is to say which move closer to the part or blank. This differs from machines of the "Incremental" (registered trade name) type, which have tools with a variable, generally progressive, profile on their periphery, and operate with a fixed distance between centers, that is to say without any relative movement of the axes of revolution of the tools and of the part moving closer together, or machines which operate successively, involving circulating the part axially with respect to the tools, the working distance between centers of which is constant.

Figure 1:
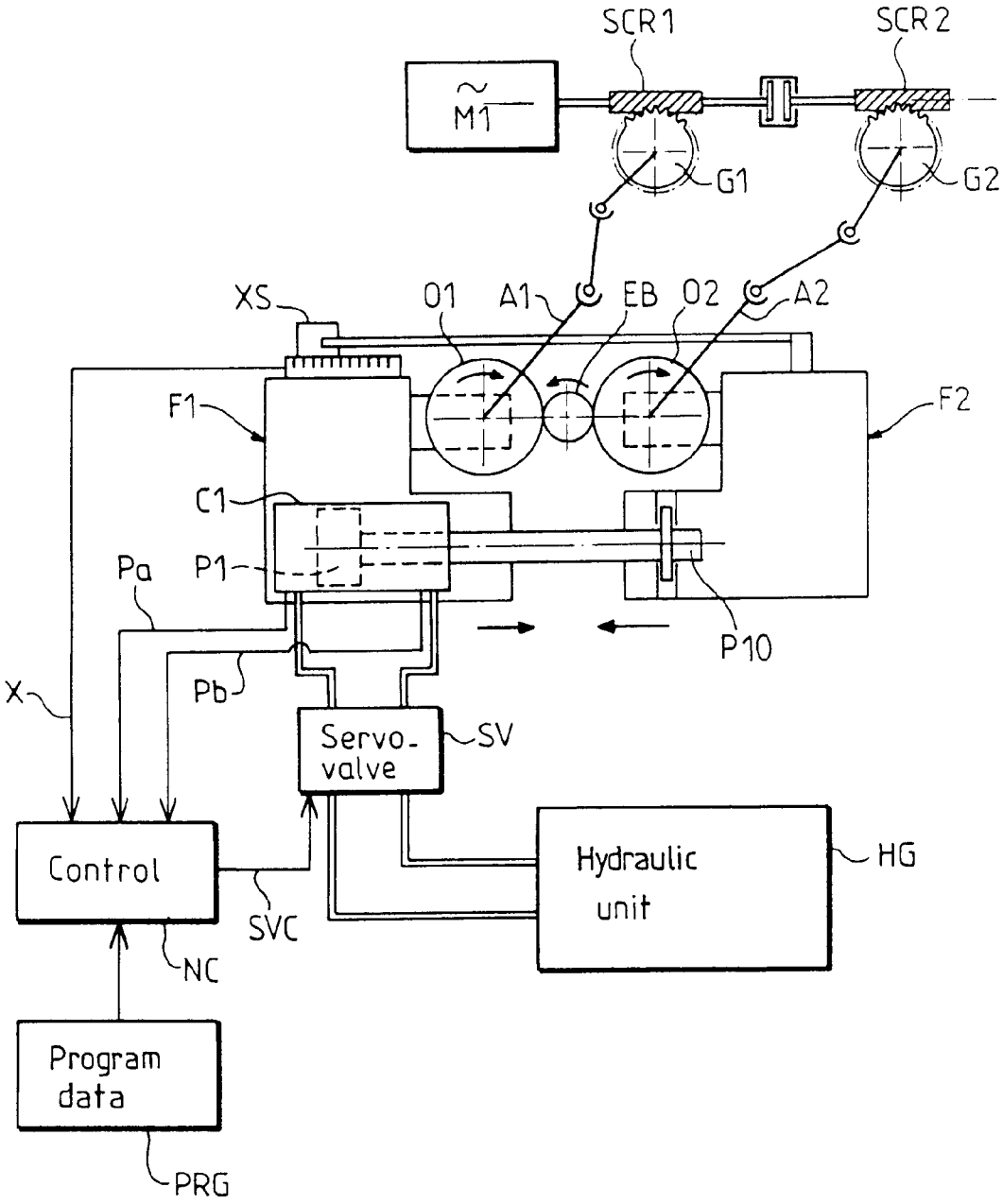
FIG. 1 schematically depicts a cold forming machine, having a first type of tool drive.

FIG. 1 relates to a rolling machine with two tools O1 and O2, which operate on a blank for forming EB (which may also be termed "part"). The machine comprises, on a general frame (not depicted), two half-frames F1 and F2, which support, in rotation, the tools O1 and O2 about roughly parallel axes A1, A2. A motor M1, for example an electric motor, drives two worm/threaded roller systems SCR1-G1 and SCR2-G2 (or just one system), the output movement of which is applied to the tools O1 and O2 to make them rotate in the same direction in sychronism. The axes A1 and A2 define the respective reference axes of the tools for forming the blank. The machine comprises, on the general frame, a support (not depicted) for the blank EB, so that it can move in terms of rotation, in the opposite direction to the tools, about an axis roughly coplanar with the two axes of rotation A1 and A2.

The two half-frames F1 and F2 can move with respect to one another, in this instance under the effect of a ram system having a piston P1 and cylinder C1, which is placed on one of the half-frames, while the end of the piston rod is fixed at P10 to the other half-frame. The lateral nature of this control may be compensated for by a mechanical equalizer, not depicted.

The machine further comprises, illustrated schematically, a sensor XS that senses the relative position of the two half-frames, therefore of the axes A1 and A2. The two chambers of the ram, one on each side of the piston P1, are fed with fluid from a hydraulic unit HG, through a servovalve SV. The latter is operated by a numerically controlled controller NC. The controller NC receives an indication of the pressures Pa, Pb in the two chambers of the ram. It also receives an indication of the position X from the sensor XS. It sends the servovalve a command SVC, in correspondence with program data PRG and its inputs.

FIG. 1 corresponds for example to machines of the series Hxx CN of ESCOFIER TECHNOLOGIE, where xx corresponds to two figures indicating a size.

Having fitted the blank, the two axes A1 and A2 far enough apart, the program data is implemented to carry out the forming of the blank EB, by relative advancement of the axes A1 and A2, bearing in mind the peripheral geometry of the tools, and many other parameters. Three main phases can be distinguished from within the forming process. These are: penetration, sizing, decompression.

Figure 2:
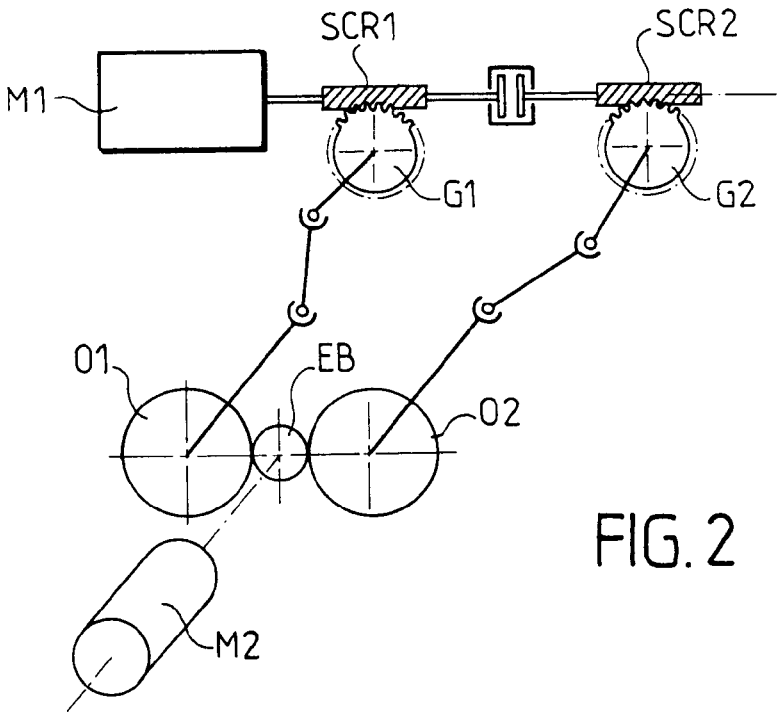
FIG. 2 schematically depicts an alternative form that applies in particular to the machine of FIG. 1.

The machine depicted schematically in FIG. 2 is of the same kind, except that instead of being moved only by the tools O1 and O2, the blank is positively driven by a motor M2, for example an electric motor. This alternative form can also apply to the embodiments which follow.

This additional or supplementary drive of the part with respect to the tools can also be implemented when the circumstances or the method so dictate (automatic indexing of toothed parts, precise division of profiles, in particular):

independent drive in the machine known as "H40 CN galetage" from ESCOFIER TECHNOLOGIE, synchronized drive in the machine known as "Syncroll" from ESCOFIER TECHNOLOGIE.

The motor M2 is then kept synchronized as desired with the motor M1, particularly bearing in mind the required synchronization ratio. This ratio may be taken between the angular velocity $\omega 1$ of the tools and that $\omega 2$ of the blank, more exactly to preserve the equality of their respective tangential speeds at their operating diameters. In the case of a toothed profile, a number-of-teeth ratio may be taken.

Figure 3:
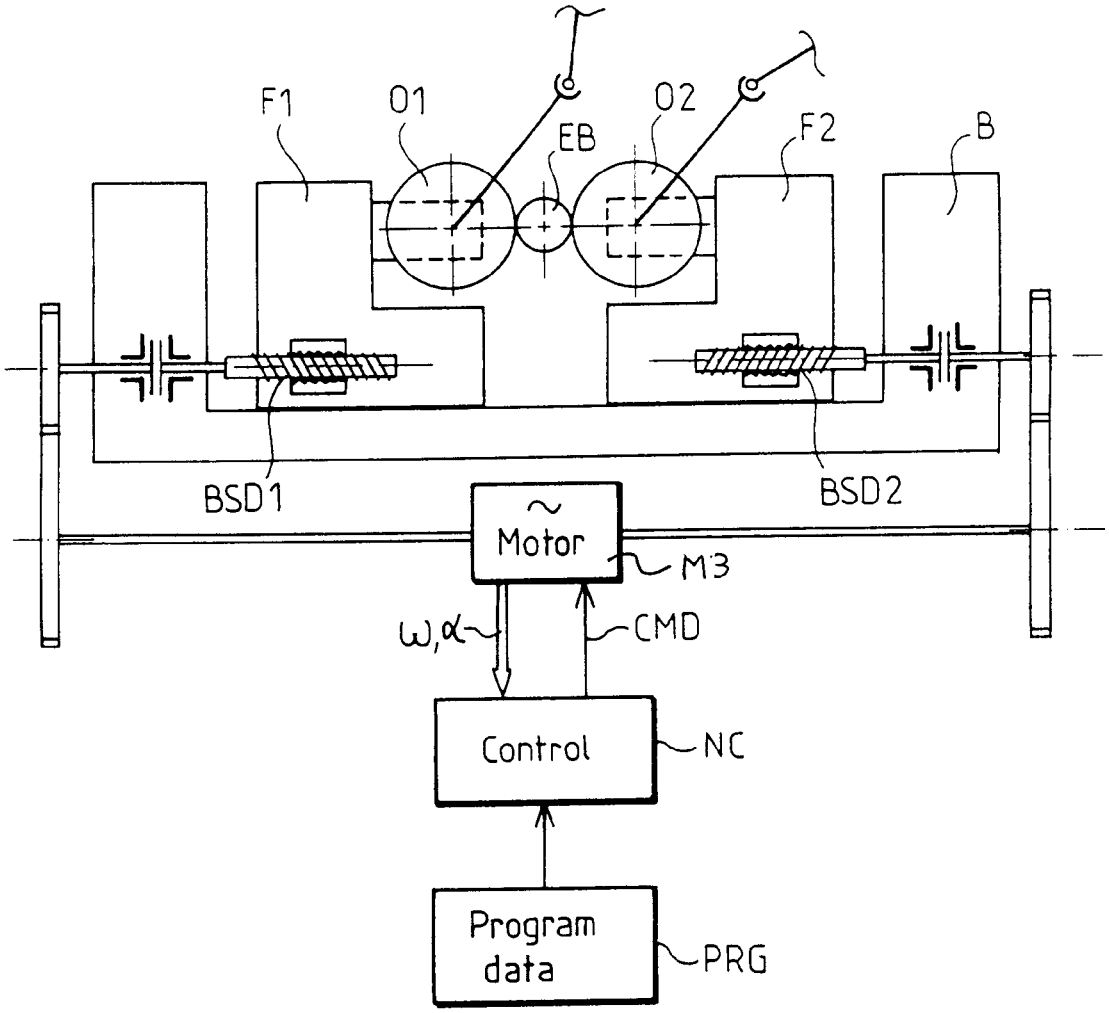
FIG. 3 schematically depicts a cold forming machine with a second type of tool drive.

FIG. 3 is similar to FIG. 1 and the driving of the tools O1 and O2 is not repeated. The difference lies in the fact that the general frame B is shown, and the half-frames F1 and F2 are mounted on it via screw/nut drive systems BSD1 and BSD2 which are actuated, by two homologous transmissions, from an electric motor M3 fixed to the frame. The controller NC receives values regarding the state of the motor, in particular information regarding the angular velocity ($\omega$) and the position of the rotor ($\alpha$); it controls the motor M3 accordingly, on the basis of program data PRG, and of the instantaneous position X, which is a function of the angular position $\alpha$.

FIG. 3 corresponds, for example, to machines of the NT series from ESCOFIER TECHNOLOGIE.

Figure 4:
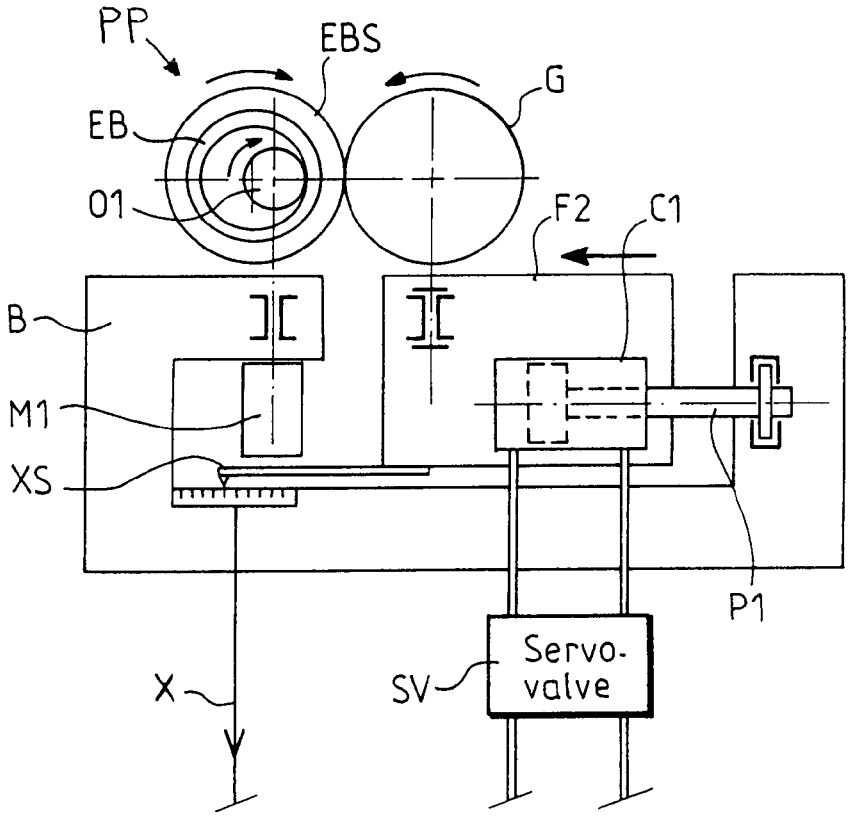
FIG. 4 schematically and partially depicts a machine of the same type as that of FIG. 1, but in which one of the tools works inside an annular blank.

FIG. 4 partially illustrates another alternative form. Here, the blank EB, which is annular, is housed in a part holder PP and the tool O1 is on the inside, driven by the motor M1, while on the outside, a roller G, driven in rotation by contact with the part holder, allows the rolling load to be applied. In the example, there is now just one carriage F2 housed in the general frame B. The position sensor XS is on the inside, between F2 and B. The control elements in FIG. 1 (SV, HG, NC, PRG) can be read across to FIG. 4, only the servovalve SV (or equivalent) being depicted in FIG. 4.

An alternative form of FIG. 4 consists in using, for drive, one of the drive systems of FIG. 3, for example the one illustrated as BSD1, and its auxiliaries, with the corresponding control elements (M3, NC, PRG).

FIG. 4 corresponds for example to the machines of the ALS series from ESCOFIER TECHNOLOGIE.

Figure 5A:
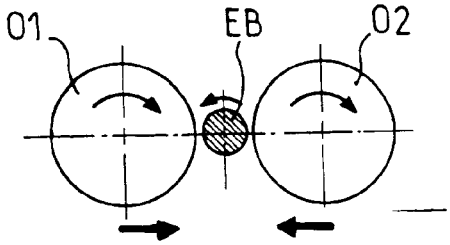
FIGS. 5A to 5G illustrate various alternative forms of the geometric arrangement of the forming tools.
Figure 5B:
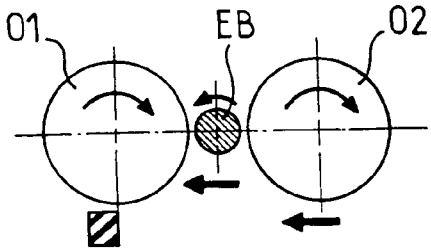
Figure 5C:
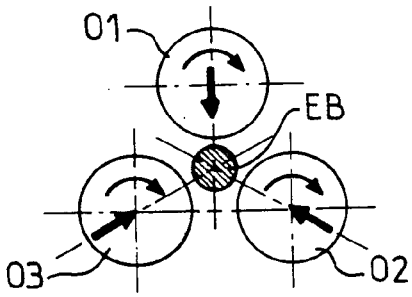
Figure 5D:
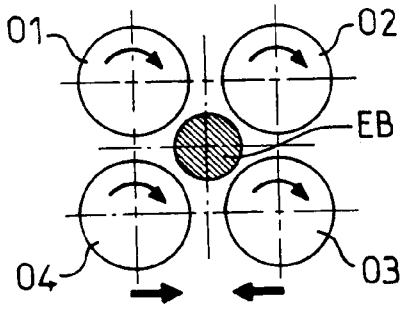
Figure 5E:
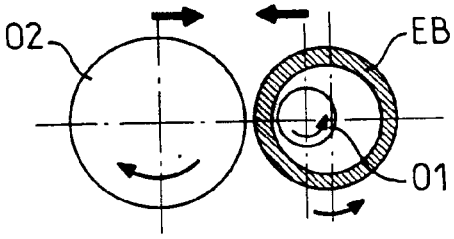
Figure 5F:
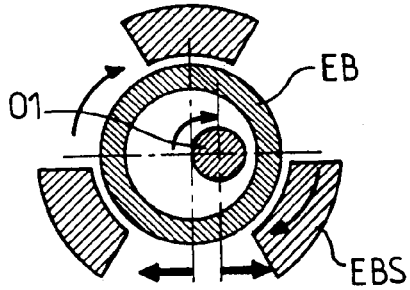
Figure 5G:
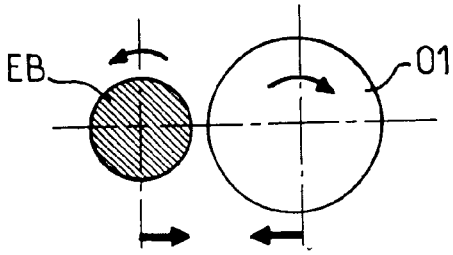

In general, it is the tools which drive the rotation of the part. However, the part may also be driven, as in the case of FIG. 2. A machine may have from one to n tools, of which the configuration, that is to say the geometric layout and support, can have various alternatives:

two external tools, both able to move in relative translation (FIG. 5A) as already described with regard to FIGS. 1 to 3;

two external tools of which one, O1, is of fixed axis, and the other, O2, of an axis that can move in translation (FIG. 5B);

more than two external tools, in theory uniformly distributed, able to move in relative translation, for example 3 tools (FIG. 5C) or 4 tools (FIG. 5D);

one tool on the inside and the other on the outside, for an annular blank (FIG. 5E);

alternative forms with just one tool, which may be on the inside (FIG. 5F), the blank being held on a support EBS which is able to move in terms of rotation, as described, for example, with regard to FIG. 4, or on the outside (FIG. 5G), the blank being mounted on a rotary support.

Furthermore, various tool peripheral geometries are used, particularly for forming splines, knurling, screw threads, gearing, or any other shape on a cylindrical base.

In the text which follows, the term "the tools" will be used arbitrarily to denote one or more tools, which are also known as "knurling wheels".

In these machines, the action of deforming the part using the tools is the consequence of the relative radial movement created between them by a movement device. This may be a hydraulic mechanism (ram) or a mechanical mechanism (screw/nut system associated with an electric or hydraulic motor). It is also possible to utilize linear motors.

The deformation of the part, in accordance with the peripheral shape of the tools, demands action which varies according to numerous parameters or factors:

the materials of the part and of the tools, the shapes produced, the respective diameters of the part and of the tools (or some other critical dimension), the area of contact between the part and each tool, resulting from the depth of penetration upon each action or pass of the tools.

The physical quantities relating to the above parameters (material hardness, contact area, rate of penetration of the tools into the part, etc.) determine at each moment the necessary and sufficient resultant load involved in the deformation.

This load needs to become high enough and to be applied for long enough (number of revolutions of the parts) to achieve the desired deformation, without causing the part to break or creating defects that make it unfit for use. If the load needs to be changed, it will be necessary to change one of the physical quantities, which will often be the rate of penetration of the tools into the part.

As the part is being rolled, its resistance to local deformation at the point at which it is in contact with the tools increases, for various reasons, including a phenomenon of the work hardening of the material, brought about by the successive deformations caused each time the tools and the part come into contact.

The pressure needed for deformation therefore increases with these phenomena.

The area deformed by the tool also increases as rolling progresses, whereas the blank little by little adopts the shape that is the conjugate of the tool or tools.

The rolling load is the product of the contact pressure of the tool or tools and the area on which these act. Assuming (for simplicity) a constant rate of tool penetration, the rolling load therefore increases as rolling progresses, and does so at least as quickly as, and generally more quickly than, this penetration rate.

In order for it to be possible to apply the required local deformation, it is necessary that, from start to finish, the part in its entirety should withstand the total force that the tools impart to it, until a final part is obtained that meets the desired geometric and structural criteria for this stage of its manufacture.

At the same time, the rolling tools are subjected to high loads. The intensity and the repetitiveness of these loads determine the length of time for which a tool can be used. In turn, the cost of the tool is an important factor in the cost of the rolling operation, and may even compromise its viability or competitiveness.

The aforementioned machines generally work on blanks of parts made of solid metal. The control loops which control the pressing of the tools on the part are controlled in terms of position, and apply the required load—whatever this may be—to maintain the anticipated relative position of tools and part at every moment during the forming process. There does not currently exist any model which makes it possible to represent the phenomenon, even for a solid material. In consequence, the control programs are written experimentally.

Various factors mean that it is sometimes desirable to use blanks made of press sintered material.

"Press sintered blank" is to be understood as meaning a part obtained in an earlier stage by sintering metal powders, that is to say a part whose relative density is still less than 100%. A press sintered blank can be obtained by uni-axial mechanical pressing of powders, and solid phase sintering. The blanks thus obtained are incompletely densified, their density ranging from 80 to 95% of that of a solid material (relative density), typically from 90 to 92%.

Parts obtained directly by press sintering are very economical to produce. However, the dimensional accuracy on their shape may be insufficient for certain demanding applications. In addition, problems may arise regarding the in-service integrity of highly stressed regions, because of the incomplete densification of the parts made of press sintered material.

At the present time, little or no use is made of cold forming of unformed press sintered blanks, in spite of the various proposals that exist:

- U.S. Pat. No. 5,711,187 and U.S. Pat. 5,884,527 describe surface re-machining of sintered gears already preformed, by conventional rolling, that is to say without worrying about or applying special teaching to the rolling conditions and their consequences;
- U.S. Pat. No. 5,659,955 also starts out with sintered blanks, and performs on them either machining which progresses lengthwise (in the direction of the axis of rotation of the blank) or, here again, surface re-machining of already preformed sintered gears, the principle of which is of the "sequential" type, on a machine with fixed distances between centers;
- other patents, such as U.S. Pat. No. 4,708,912 or alternatively German patent DE-A-3140 189 attempt to apply conventional rolling, essentially to obtain highly stressed gears.

The Applicant Company has once again invested interest in the rolling of parts made of press sintered material. It has observed that, when a rolling technique is applied to press sintered blanks, the limits and conditions on the production of the parts from these blanks differ greatly from those which would be encountered in respect of identical parts rolled from a solid blank made of the same material. What happens is that the density and the strength of the press sintered material are below those of the solid material, and the spread on the dimensional characteristics of the blanks is wider, particularly in terms of eccentricity and circular symmetry.

It has been observed in particular that:

- the core of the press sintered part has lower resistance to the various mechanical stress than a solid part, and
- whereas the surface pressure needed for deformation will increase with the peripheral densification resulting from this deformation, until it reaches a value close to that of the solid material.

Here, "densification thickness" is used to denote the distance between the outer surface of the part and its boundary on the core side, where the press sintered material maintains the initial density of the blank (the density obtained in the last sintering operation).

With conventional rolling techniques, it has been found that this "densification thickness" is small, generally less than 1 mm. This may be enough to improve the in-surface integrity of fairly highly stressed gears. This is what is described in Patents U.S. Pat. No. 5,711,187 or U.S. Pat. No. 5,884,527, which show that densification of 90 to 100% over a thickness of 0.38 to 1 mm at the root of the teeth and/or on the flanks of the teeth of a gear may prove suitable, without, however, describing precisely how to achieve this industrially.

In general, this densified layer, which is locally stronger, is not enough to withstand the overall deformation load when this becomes high; next, the core is not itself strong enough. This gives rise to various forms of deterioration. In particular, it results in local or complete rupturing of the part, for example starting from the core, in the case of solid parts, or starting from the surfaces, in the case of ball bearing rings. The Applicant Company has observed that excessive tri-axial stresses arise on regions which are insufficiently able to withstand rupture because they are not completely densified. There have also been observed phenomena of the material collapsing or of it breaking up at the surface, which then falls off as dust or small fragments and makes continuing to roll impossible. Also observed has been instability of the deformation, which seems to be specific to press sintered material; the result of this is that the setting of the conventional rolling parameters determined on a given blank may not suit the next blanks, leading to random and therefore unacceptable results, because of their lack of reproducibility in the face of the tolerances inherent to the production of blanks using press sintering.

In other words, because of its granular nature, the press sintered material has significant variations in homogeneity, which are exacerbated by the method of manufacture of the blanks. These variations are wide enough to contribute to increasing the difficulties in mastering the rolling conditions, as needed for generating parts which meet the geometric and functional desires of the user.

Furthermore, a rolling technique applied to sintered materials will have, on the tools, the same effect as it has when applied to a solid material subjecting it to the same rolling stresses, particularly on the length of time for which they can be used. It is clear that the aforementioned difficulties, particularly the risks of parts rupturing, are of a kind that will markedly reduce tool life.

The Applicant Company has observed that it is possible to improve things by taking an approach which is the opposite of the approach hitherto taken.

Figure 6:
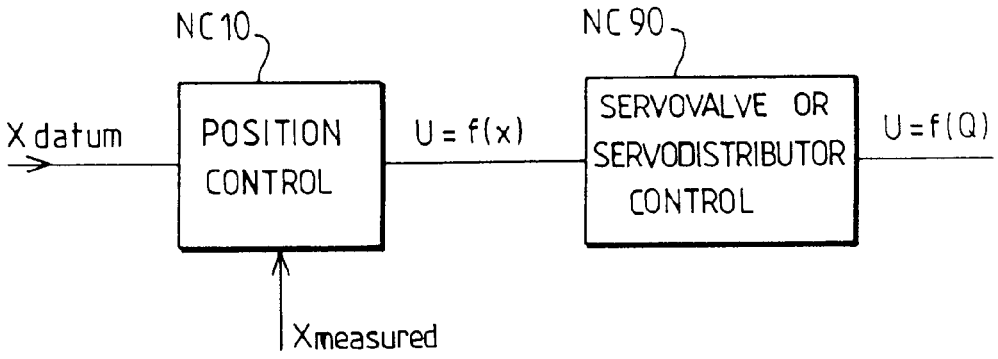
(PRIOR ART) FIG. 6
FIG. 6 is a flow diagram of a known machine control, using position control.

Conventionally, in the case of a servovalve or servodistributor (FIG. 1), NC-type control is performed as indicated schematically in FIG. 6. The output stage NC90 which controls the servovalve is itself controlled by a stage NC10 which defines the throughput of the servovalve as a function of the current position X, and possibly as a function of its previous values (or its derivative). The action is therefore in fact on the rate of advance of the tool or tools and therefore on the positions.

Figure 7:
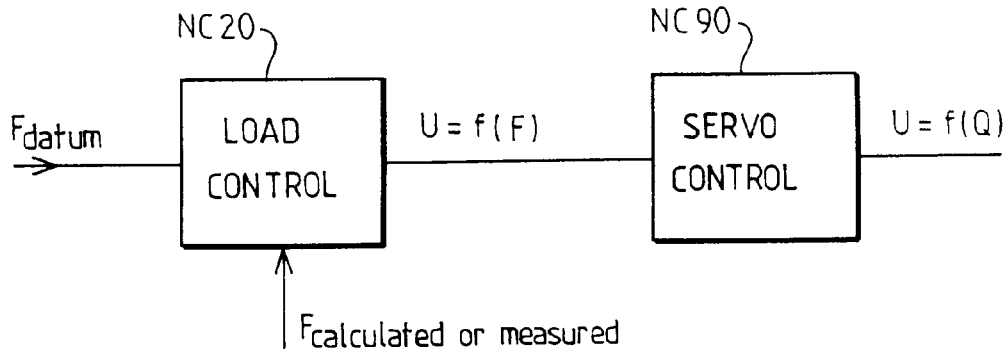
FIG. 7 is a flow diagram of a machine control used according to the invention, with force control.

It is possible to proceed in a different way, as indicated schematically in FIG. 7. The output stage NC90 which controls the servovalve or the servodistributor is itself controlled by a stage NC20 which defines a variation in the throughput of the servovalve or of the servodistributor, so as to control the forces or loads transmitted to the part or blank during the rolling cycle, as a function of the current load. In this particular instance, this load is calculated from values from pressure sensors, such as the aforementioned Pa, Pb, bearing in mind the areas exposed to the fluid on each side of the piston. The load can thus be measured.

It has been found that this improves the rolling characteristics, and the characteristics of the part obtained; furthermore, it extends the life of the tools, and preserves their integrity while at the same time avoiding overload.

In other words, with a view to rolling sintered parts, there is proposed a method of rolling with controlled loads or forces, preferably via a control loop or, more generally, feedback.

As with positional control of the prior art, the behaviour of a blank subjected to rolling under force or load control cannot currently be modelled, even for a solid material, and especially for a press sintered material. In consequence, the control programs are written experimentally, at least in respect of phase (b).

In FIG. 7, control of the load delivered by the rolling system (machine) is obtained with reference to automatic control of a tool movement hydraulic system. The person skilled in the art knows how to transpose such automatic control to other movement systems, particularly an electric motors system as illustrated in FIG. 3.

The system for measuring physical variables of load and position, needed for automatic control and control, such as, for example, distance travelled, angle of rotation of a screw-nut system, pressure of a fluid, strength voltage frequency of a current, strain on a corresponding gauge, are chosen in accordance with the solutions adopted for the design of the various types of machine concerned.

It has been found that load or force (automatic) control is markedly superior to position (automatic) control. In the absence of a model, the phenomena involved are difficult to analyse. It would, however, seem that this superiority stems in part from the fact that load or force control gives better tolerance towards any problems there might be which are associated with press sintered blanks, given the response of the control sequence. This superiority to a great extent compensates for the disadvantages associated paradoxically with the use of load or force control even though the desired end result is that of obtaining a precise position (in absolute or relative terms).

Furthermore, it has been found that, all other things being equal, the densification thickness obtained with "load" control is generally a little greater than that obtained with position control. This seems to be due to better "regularity" of the rolling action, in the presence of imperfections. At the same time, work hardening can be controlled better. The same is true of the effects of the variations in ambient temperature on the machine, and of the temperature of its internals, particularly the motor elements (such as the fluid). The same is also true of the effects of the surface heating of the part or blank, which are also better controlled. Furthermore, this heating is not as significant, because of the better control over the work hardening.

In greater detail, the following advantages have appeared for load (automatic) control. It makes it possible:

a) no longer to be subject to the variations in the actual position of the tools, with respect to the measured position, consequences of the variations in load on mechanical elements which (machine included) in fact behave like big springs (of spring rate K), b) to be able to enjoy the full benefit at the start of rolling of the advantages of a material which has not yet been affected by work hardening, which is useful for the final mechanical strength but unfavourable in terms of deformation and its progressiveness and tends to give rise to local heating of the part or blank.

The difficulty stems not only from the effects of small irregularities of all kinds, but also from the fact that the interaction between a given region of the blank and the active tools takes place in a "chopped" way, n times per blank revolution, where n is the number of active tools.

Figure 8:
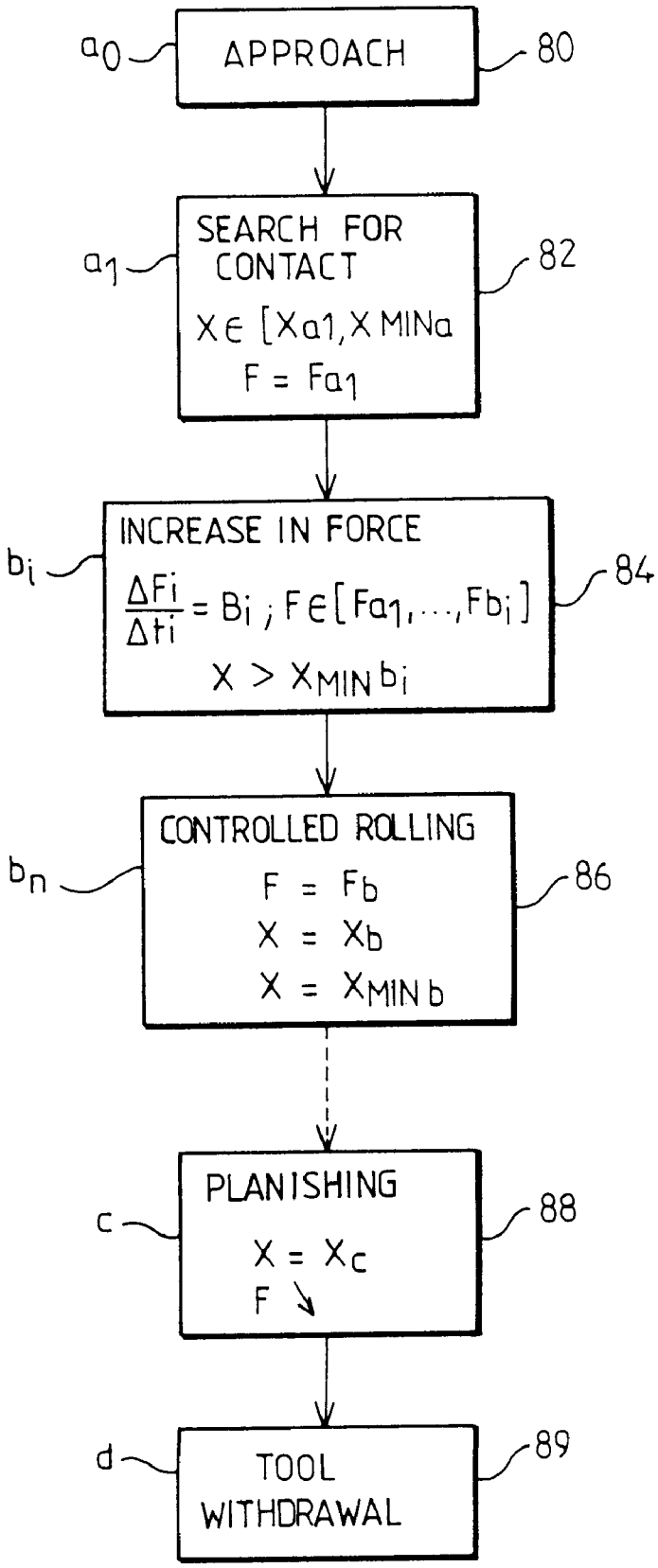
FIG. 8 is a diagram of steps illustrating an exemplary implementation of the invention.

One exemplary embodiment will now be described with reference to FIG. 8, and to Table 1 of Annex 1. In this Table 1, the grey boxes indicate, in each phase, the essential quantity or quantities on which the numerical control relies. The tools are constantly rotating, as indicated in the angular velocity column ω.

In this example, rolling cycles comprising the operations described hereinafter are implemented.

In general, the positions X are considered to be decreasing when the tools are approaching the part (because the tools are then approaching one another, and at the same time approaching the part).

An initial approach operation 80 or ($a_0$), not represented in Table 1, may be carried out in any desired way, until the tools are in a position a short distance away from the part.

Next, phase 82 or ($a_1$)–(a) in Table 1—achieves contact with the part. It comprises a slow advance at a speed Ca, and under light load Fa, associated with the movement of the carriages. Contact is achieved by looking for the position Xa, lying between $Xa_1$ and $Xa_2$, for which the load needed to advance increases substantially to a value $Fa_1$, indicating contact between tools and part. The advance can be bounded by a minimal position XMINa.

The threshold load value $Fa_1$ is suitably adjusted to avoid the tools making a damaging imprint in the part upon first contact. This adjustment is trickier to achieve with a press sintered blank and may need to be performed by prior iterations, during optimization tests.

It is important to note that, upon contact, the part begins to turn (except perhaps when it is moved separately).

In operation (b) or 84+86, the load applied to the tools, as a result of their relative movement with respect to the part, then increases progressively and in a controlled fashion to a desired level Fb. A limit is set on the advance X, to avoid the possible disastrous consequences of the press sintered material beginning to collapse in on itself (like a human foot would cause on uncompacted snow). Here, "collapse" is to be understood as meaning an unexpected sharp change in position.

As a preference, the initial phase or phases 84 of operation (b) are carried out with one or more levels of rate of load increase. In the example depicted, two rates of increase are envisaged, these being equal approximately to $(Fb_1—Fa_1)/Tb_1$, then $(Fb_2–Fb_1)/Tb_2$, to reach the levels $Fb_1$ and $Fb_2$, respectively.

Thus, the progression of the load applied to the blank can be kept below a defined limit value, so as not to cause a critical state to arise during deformation (in particular so as not to initiate the aforementioned collapse). That being so, the increase in load is chosen to be as rapid as possible, so as to limit the effects of work hardening as a result of the successive contacts between the tool and the part. What happens is that excessive work hardening results in superficial hardening, which causes the load required to continue forming to increase and therefore also increases the risk of running into a critical state, it being remembered that the blanks have dimensional tolerances, surface irregularities and also intrinsic inhomogeneity.

These initial phases (b) are important for obtaining deformation which is as uniform and progressive as possible at the start of rolling whereas, in particular:

- the sintered blank always has defects in dimension, roundness, concentricity and homogeneity;
- the depth of action of the tools in the part changes between a zero value (contact between the tools and the part at the start) and a depth that results from their progressive penetration as the part rotates before the original point of contact once again meets the tools (half a revolution of a part, for example, on a machine with two knurling wheels); and
- the mechanical parts of the machine experience variable deformations in relation to the variation of the working load.

In the final phase 86 of operation (b), the load is then controlled (F) for one or more successive phases, so that its change continues to observe a predefined cycle, until a final relative position (Xb) of the tools and of the part is reached which tallies with the final dimension of the part.

The simplest solution is a single phase with automatic control under constant load ($Xb=Xb_2$) until the desired final position is obtained. Conversely, the most complicated solution may be a succession of phases with load control changing progressively, uniformly, or in successive levels, in a controlled way. In general, the automatically-controlled load values Fb remain close to the load $Fb_2$ achieved at the end of step $b_2$ (or more generally $b_n$)

It is also possible to include intermediate phases in order, for example, to change the direction of rotation of the tools. Of course, numerous intermediate solutions are conceivable.

In all the load controlled phases of operations (b) and/or (c), the relative position of the tools and of the part at each moment "t" is a consequence of the control over the controlled load, as programmed up to that moment "t".

During phase (b), generally known as "penetration", surface densification of the blank is achieved over a chosen densification thickness. This densification thickness depends on the density of the blank before rolling, on the nature of the material of which it is made, and on the geometric modification imposed by the tools during rolling, bearing in mind the controlled load values applied. Here again, the conditions required for obtaining a chosen densification thickness may be determined by tests beforehand.

Optionally, a final sizing phase, denoted 88 or (c) may be performed. This phase may use position control, to set a tool/part relative position (Xc). This may, for example, make it possible to obtain a part which meets roundness criteria predefined by the user. The load is no longer the basic quantity for the automatic control in this phase, and varies generally in a roughly decreasing manner down to a low value associated with the plastic deformation limit value, below which the part will experience only elastic deformation. In this finishing phase (c), the blank/tool relative position is kept roughly constant for a chosen length of time defined to obtain a part of acceptable geometry, particularly of accepted roundness.

In the last steps of the load control, it is necessary to master the transition with the following is so as to avoid "position overshoot" and/or "load overshoot" which could compromise the quality of the part.

In principle, the periphery of the rolling tool or tools is roughly circular (in cross section) or generally cylindrical (with respect to a mean diameter, in the presence of teeth, or of a screw thread). The blank may be preformed, particularly with teeth, in which case, in principle, the tool or tools are equipped with homologous teeth. As an alternative, the blank may be preformed as a ring, particularly the ring of a bearing, in which case, in principle, the tool or tools has a uniform external periphery (not necessarily cylindrical of revolution).

A terminal decompression phase (d) or 88 is provided, for withdrawing the tools away from the part. This phase may be determined conventionally in terms of retreat rate or better controlled, in the form of an automatically controlled decreasing load.

In the foregoing, the penetration phase or phases take place under load control. As the objective is to reach a programmed position Xb, the automatic control is ended when the desired position is reached (86). The whole thing can therefore be termed load/position (load then position) control.

Alternatives are conceivable. For example, load/excursion control may be performed, in which the load control is maintained until a programmed excursion or distance has been covered. In this case, the final position is a programmed consequence of the initial position (contact point), in relative terms, rather than as a position in absolute terms. This may be used, for example, to reduce by a roughly constant value blanks which have a variable starting diameter. It is also possible to envisage other conditions for load control such as, for example, "load/time" control, with fixed time. This may in particular be suitable where the control of the diameter of the part is not critical, for example:

- for special operations such as roller burnishing, or alternatively;
- when the cycle of rolling a blank contains several sub-cycles, with or without reversal of the direction of rotation between sub-cycles, in the case of the sub-cycles preceding the final sub-cycle.

It has been seen that the method thus described performs cold forming by rolling of a blank made of press sintered material, in which at least one tool of predetermined peripheral geometry is brought close to the blank so that the tool can then be rolled over the blank, urging the one towards the other. After a phase (a) of approaching the blank, the method comprises a penetration phase (b).

According to one aspect of the invention, this penetration phase comprises, towards its end ($b_n$), at least one phase of rolling under roughly constant load, as far as a chosen position, this load, the chosen position, and the corresponding number of passes being determined so as to control the surface densification and the dimensions of the rolled part. The roughly constant load may be defined with respect to a critical value, kept below the deterioration threshold, which can be determined experimentally and/or in some other way (for example by extrapolation from similar parts). The expression "roughly constant" is to be understood as meaning a variation which may be of the order of 10% of the critical value. The 10% are preferably taken under the critical value, which may allow this critical value to be brought close to the deterioration threshold, if so desired. In that very way, it is possible to reduce the rolling time and then to have better control over the work hardening.

In other words, phase (b) may include keeping the load applied to the blank below a limit value defined with respect to a threshold at which the press sintered blank deteriorates. The deterioration may stem from a rupturing of the core, breaking-up of the surface, and/or induced work hardening. The deterioration threshold depends on various factors such as the stresses that the blank can tolerate with respect to the desired conformity of the finished part, and the stresses associated with the desired tool life. Phase (b) may also include keeping the load applied to the blank at a value close enough to the limit to avoid excessive work hardening while at the same time minimizing the rolling time (on which the cost of production depends). However, there are applications such as "roller burnishing" (which corrects the geometry of a part), in which work hardening is not as critical, or may even be desired.

According to another aspect of the invention, which can be dissociated from the previous one, the penetration phase (b) is performed at least partially under load control.

According to yet another aspect of the invention, the phase ($b_n$) of rolling under roughly constant load may be preceded by ($b_1$) at least one phase in which the rolling load increases, bounded by a maximum value of this rolling load. It is currently preferable for the increase in load in phase ($b_1$) also to be bounded in terms of the progression of the load over time. More specifically still, the increase in load in phase ($b_1$) may be carried out according to a critical law which tends to bring the progression close to an experimentally determined permissible limit value that takes account of the geometric and mechanical properties of the blank and of the finished part. This makes it possible to get close to the ideal situation which (except in special cases) consists in increasing the load as swiftly as the characteristics of the blank and of the finished part permit.

The periphery of the tools may be uniform or smooth, so as to form rings or bearing surfaces, something which is particularly advantageous with press sintered material since the material can densify, without spreading longitudinally in the direction of the axes A1 and A2, like a solid material would. Benefiting at least in part from the same advantage, it may also adopt other predetermined shapes: screw threads, or annular grooves, or straight-cut or helical teeth, particularly to form splines, knurling, a screw thread or a gear.

Furthermore, the blanks may themselves comprise shapes originating from press sinter production, for example teeth.

Figure 9A:
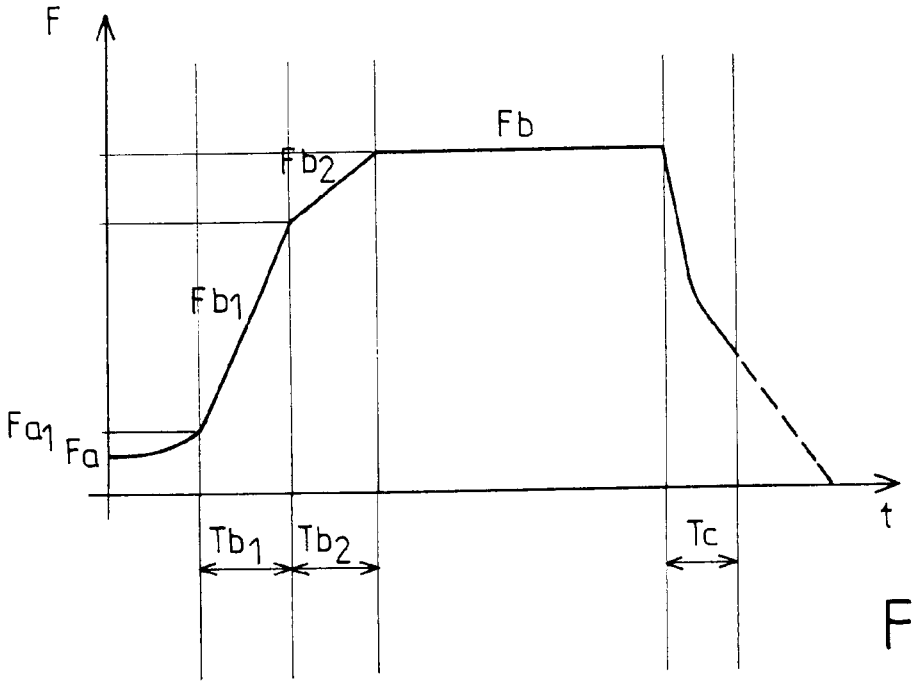
FIGS. 9A and 9B are schematic time charts of force and position respectively, in one example of an application of the invention.
Figure 9B:
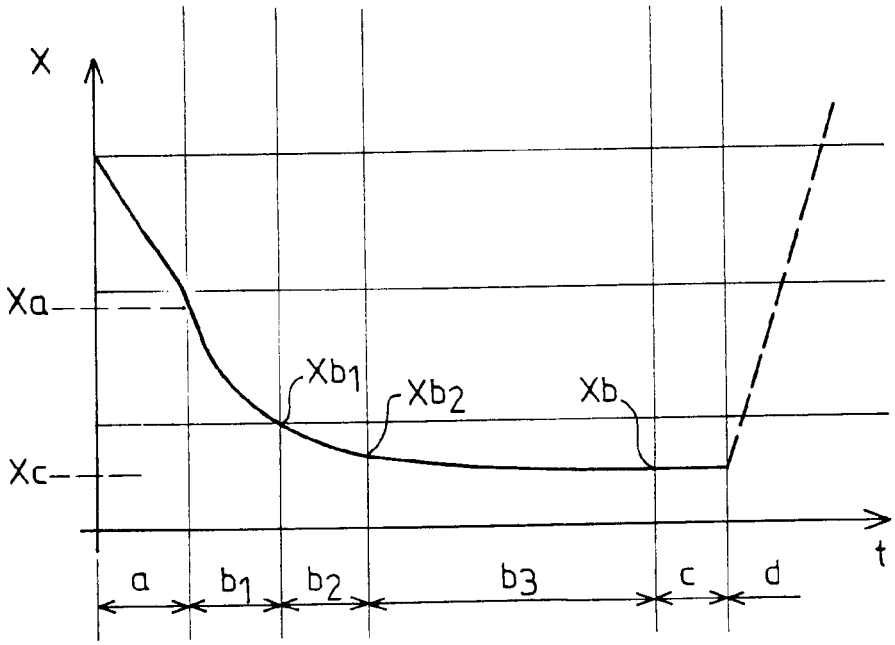

FIGS. 9A and 9B illustrate general appearances of force and position curves that can be seen according to the invention. Here, there are two phases ($b_1$) and ($b_2$) which comprise, before the level F=Fb, different rates of increase of load, here constant and equalling:

$$(Fb_1-Fa_1)/Tb_1 \text{ and } (Fb_2-Fb_1)/Tb_2.$$

Figure 10:
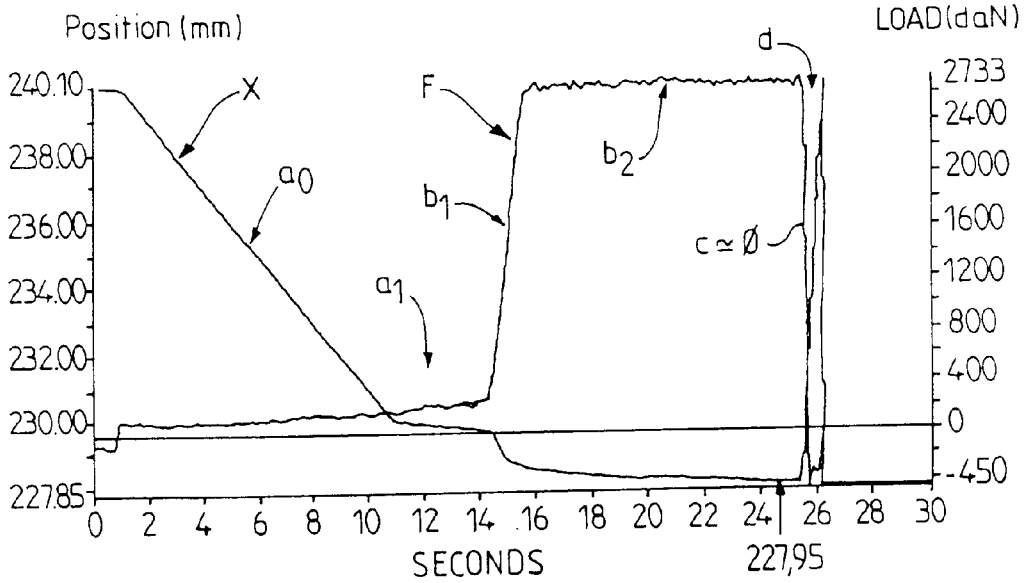
FIGS. 10 to 13 are measured force and position diagrams in various exemplary implementations of the invention.
Figure 11:
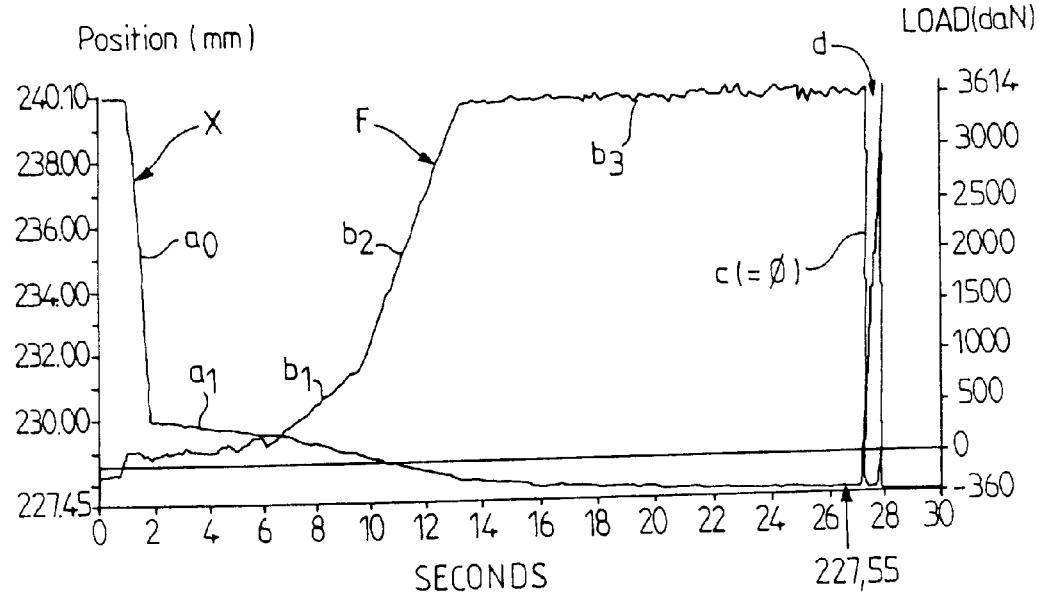
Figure 12:
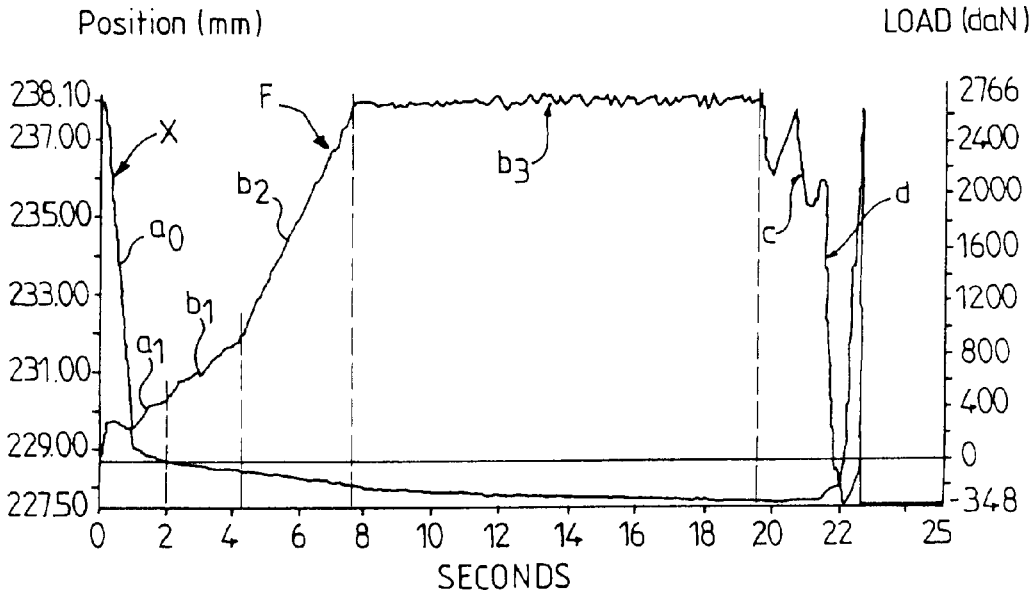
Figure 13:
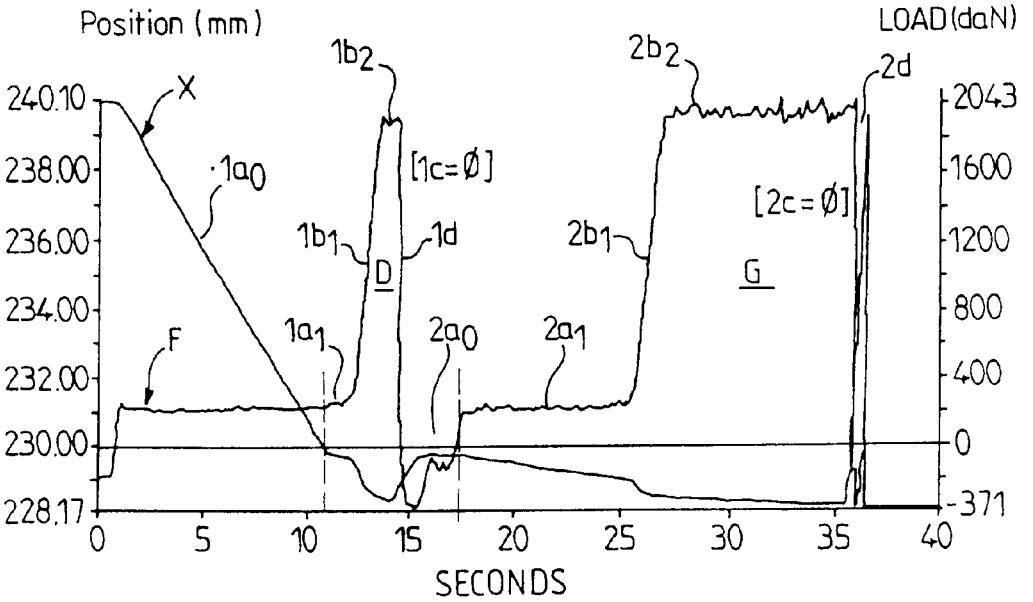

FIGS. 10 to 13 illustrate actual position (scale on the left) and force (scale on the right) curves. The increase in position on the right corresponds to the withdrawal of the tools, in phase (d). The following comments can be made on these diagrams:

FIG. 10: semi-rapid approach ($a_0$, $a_1$), rapid increase in load ($b_1$), rolling ($b_2$) under roughly constant load, no phase (c), very short phase (d);

FIG. 11: differs from FIG. 10 by a more rapid approach ($a_0$, $a_1$), two-phase increase in load ($b_1$, $b_2$), starting slowly and then becoming more rapid; rolling ($b_3$) under roughly constant load, no phase (c), very short phase (d);

FIG. 12: differs from FIG. 11 by an even more rapid approach ($a_0$, $a_1$); the increase in load ($b_1$, $b_2$) is also in two phases, with different rates; phase (c) has an overall decreasing load, but with fluctuations due, in the presence of a fixed distance between centers, to the slight but inevitable geometric imperfections upon tool/part contact particularly regarding the roundness of the part (with two tools, a given region of the part encounters a tool twice per revolution);

FIG. 13: generally similar to FIG. 10, but with a split into two parts 1$a_0$ to 1$d$ and 2$a_0$ to 2$d$; a reversal of the direction of rotation of the tools may be performed between the two parts, at the start of 2$a_0$. In other words, the approach phase (a) and the penetration phase (b) are repeated after the direction of rotation of the tool or tools has been reversed. This may be performed several times.

Figure 14:
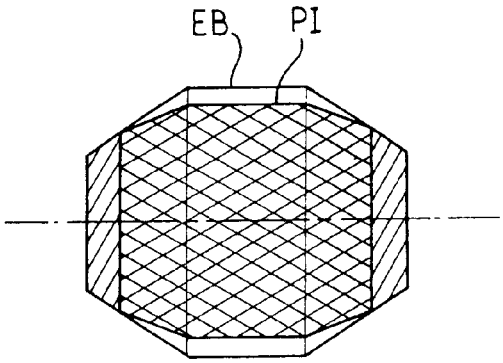
FIG. 14 schematically illustrates a blank and a part for one particular example of rolling.

FIG. 14 is a schematic sectional view which shows the blank EB, and the finally desired part PI. The hatched region corresponds to the part of the blank which is not modified by rolling and the cross-hatched region shows the final geometry of the part, whereas the blank has slightly larger dimensions, as illustrated. Such a part is known by the term "biconical roller" and may, for example, have a diameter of 30 mm (blank).

Such a part can be manufactured using a conventional method, using position control (expressed in speed and in final position), to obtain a final outside diameter of 29.5 mm. In practice, variations in excess of 30$\mu$ on the final diameter and even a roundness defect in excess of 30$\mu$ are observed. This is accompanied by surface work hardening.

This spread in the part obtained stems, on the one hand, from the spread in the diameters of the blank and, on the other hand, from the spread in the shape of the blanks (as regards the width of the cylindrical part and the width of the cones), and then again from a spread in hardness between one blank and another, and also finally from variations in homogeneity in the press sinter of which the blank is made.

It has been found that the aforementioned spreads resulted in variations in the mean load applied when switching from one blank to another, and in fluctuations in load in the course of a cycle, with a generally continuous increase in the load applied.

There are secondary consequences which ensue from this, and these are fluctuations in the actual distance between centers of the tools, with respect to the position-controlled distance between centers. This can be expressed using a relationship of the form $\Delta X=f(F)/K$, where K can be considered as being the spring rate for the mechanical parts concerned, in the rolling machine.

The same kind of part has been prepared by rolling according to the invention, with load control, followed by final position control for the super-finishing.

As far as the parts are concerned, the variation in end diameter is now at most equal to 15$\mu$. The variations in roundness are at most equal to 10$\mu$. This clearly illustrates the advantages that can be obtained using the present invention, particularly better repeatability.

It has also been found that, for the same cycle time, the mean load obtained by the automatic control according to the invention is lower than the maximum load that could be observed in the position control according to the prior art.

Besides that, using the invention, it is possible to have a cycle time varying from one blank to another. However, in any case, the cycle time needed with load control remains shorter than the cycle time obtained previously with conventional position control.

Implementation of the invention also results in a variation in the tool advance rate, as a function of the actual strength of the blank being rolled.

Induced consequences result from all of that. The first is the absence in fluctuation between the actual distance between centers and the measured distance between centers because $\Delta X=f(F)/K$, which can be considered as a constant, in so far as the load is constant. It is also found that there is less work hardening of the press sintered material, for an equivalent reduction in diameter, because the cycle time is shorter.

Furthermore, the fluctuations in speed and rate are low enough that the roundness can be suitably mastered. In consequence, there is less spread, from one blank to another, in the parts obtained, or in other words, the rolling is more repeatable.

Other experiments were carried out.

Considered first of all was the rolling of gears, for example a 28-tooth helical gear with an actual module $m_n$=2, an actual pressure angle $\alpha_n$=15°, and a helix angle $\beta$=32° (international notation).

These parts are difficult to produce with position control rolling. Various tests have been carried out with load control rolling, with the terminal planishing phase using position control.

The Applicant Company has looked for conditions corresponding to a reduction in diameter on the flank and on the root diameter, in order to achieve the diameters fixed to the plane of definition, from preformed blanks of different types and geometries. Variations in the densification thickness stem from this.

While looking for the maximum limits, the Applicant Company observed, for a reduction in diameter of as much as 0.5 mm at the root of a tooth, that there was premature breakage of the rolling tools, after a few dozen parts had been rolled (something which is economically unacceptable) whereas, for its part, the programmed rolling load was as much as about 3 500 daN. That stems from the existence of excessively high mechanical stresses on the teeth of the tools, hence causing the teeth to break at their roots.

From that, the Applicant Company observed that there was a critical load, relating in particular to the integrity of the tools. This critical load can be achieved by altering the necessary useful load, which in this particular instance was set at a maximum value of 2 300 daN. The blanks were also modified to reduce the densification thickness, restricted to 0.3 mm at the roots of the teeth, in this example. Having made these modifications, it was possible to obtain satisfactory rolling conditions.

If, with these new rolling parameters, an oversized blank is introduced:

- the time (that is to say the number of revolutions of the part or blank) will be increased;
- a safety feature may stop the machine if the cycle becomes too long; and
- the tools do not break.

Other experiments were carried out for the rolling of discs, for example of diameters of 35 mm and widths of 10 mm.

Conventional rolling was carried out with position control, so as to obtain a final dimension of 34.50 mm. The result was that parts broke and ruptured into multiple fragments. The analysed cause was a spread of hardness between blanks. This resulted in a final load which varied from one part to another, occasionally adopting excessively high values which caused the aforementioned breakage. A possible remedy (known in position control) in such instances is to reduce the rate of advance. However, this results in an excessively long rolling time (or number of revolutions of the parts) which results in excessive surface work hardening of the part or blank, and in it breaking up.

On the other hand, by using load control according to the present invention, satisfactory parts are obtained. The maximum load is limited but constant. The consequence is a reduction in diameter which is more rapid at the start of rolling, on material which has not yet been work hardened. It is then possible to work over a number of revolutions which on average is lower, and therefore with less work hardening overall.

The invention is not restricted to the embodiments described. Thus, alternative forms of the machines described in FIGS. 1 to 4 can be used, and in particular:

- two motors for driving the tools O1 and O2, respectively, with or without a mechanical connection between their reduction gears,
- two motors for driving the screw/nut systems BSD1 and BSD2 in FIG. 3, two rams for moving the two carriages F1 and F2 with respect to the frame B in FIGS. 1 and 2, and adaptations for machines with 3 or more tools.

More generally, the load control described can be applied to the rolling of parts according to variable facilities and implementations, on the basis of the techniques currently applied, or of others yet to arise in this field, such as linear motors, for example. Of course, that can be accompanied by various techniques for obtaining load control. The measurement quantities are not necessarily loads: it has been seen that it is possible, in particular, to use pressures, this being merely one non-limiting example. The action quantities are not necessarily loads either, so long as it is known how to connect them to loads or forces with the required precision.

The invention also covers the essential element which constitutes a programme for operating a numerical control machine for carrying out the method, in all its alternative forms described.

TABLE 1

Annex 1

| Phase | X | F | rpm; t | dX/dt | dF/dt | ω |
|---|---|---|---|---|---|---|
| a | $XMINa < X < Xa_1$ | $F = Fa_1$ | — | Ca | — | $\omega a_1$ |
| $b_i$ | $X > XMINb_i$ | $Fa_1 \rightarrow Fb_i$ | Tb | — | $(Fb_i - Fa_1)/Tb_i$ $(Fb_i - Fb_{i-1})/Tb_i$ | $\omega b_i$ |
| $b_n$ | $X = Xb$ $X > XMINb$ | $F = Fb$ | — | — | — | $\omega b$ |
| c | $X = Xc$ | — | Tc | — | — | $\omega c$ |

What is claimed is:

1. A method of cold forming a blank made of press sintered material, comprising:

moving at least one tool towards the blank; and subjecting the blank to rolling under a roughly constant load for a number of passes until the at least one tool reaches a chosen position, wherein at least one of, the chosen position, the roughly constant load, and the number of passes, is determined so as to control a surface densification and at least one dimension of the rolled blank.

2. The method of claim 1, wherein the at least one tool has a predetermined peripheral geometry.

3. The method of claim 1, further comprising rolling the at least one tool over the blank.

4. The method of claim 1, further comprising urging the at least one tool and the blank towards one another.

5. The method of claim 1, wherein each of the chosen position, the roughly constant load, and the number of passes is determined so as to control a surface densification and at least one dimension of the rolled blank.

6. The method of claim 1, further comprising controlling the roughly constant load.

7. The method of claim 1, further comprising, before the subjecting, rolling the blank with an increasing load.

8. The method of claim 1, further comprising, before the subjecting, rolling the blank with an increasing load up to a maximum value.

9. The method of claim 1, further comprising, before the subjecting, rolling the blank with an increasing load up to the roughly constant load.

10. The method of claim 1, further comprising, before the subjecting, rolling the blank with a controlled increasing load up to the roughly constant load.

11. The method of claim 1, further comprising, before the subjecting, rolling the blank with a controlled increasing load.

12. The method of claim 1, further comprising, before the subjecting, rolling the blank with an increasing load that is determined according to a critical law which tends to bring a load progression close to an experimentally determined permissible limit value that takes account of geometric and mechanical properties of the blank.

13. The method of claim 1, wherein the subjecting comprises maintaining the roughly constant load below a limit value defined with respect to a threshold at which the blank deteriorates.

14. The method of claim 1, wherein the subjecting comprises maintaining the roughly constant load below a limit value defined with respect to a threshold at which the at least one tool deteriorates.

15. The method of claim 1, wherein the subjecting comprises maintaining the roughly constant load at a value close enough to a limit value to avoid excessive work hardening while at the same time minimizing a rolling time.

16. The method of claim 1, wherein the moving and the subjecting are repeated after a direction of rotation of the at least one tool has been reversed.

17. The method of claim 1, further comprising subjecting the blank to finish rolling.

18. The method of claim 17, wherein the finish rolling comprises maintaining the roughly constant relative positions of the blank and the at least one tool for a chosen length of time.

19. The method of claim 1, wherein the at least one tool comprises peripheral profile that is at least one of roughly circular and generally cylindrical.

20. The method of claim 1, wherein the blank comprises a preformed part.

21. The method of claim 20, wherein the preformed part comprises teeth.

22. The method of claim 20, wherein the preformed part comprises a ring.

23. The method of claim 22, wherein the ring comprises a bearing ring.

24. The method of claim 1, wherein the at least one tool comprises teeth.

25. The method of claim 1, wherein the at least one tool comprises a uniform external periphery.

26. The method of claim 1, further comprising controlling the moving and the subjecting via a program.

27. The method of claim 26, wherein the moving and the subjecting occur on a numerically controlled machine.

28. The method of claim 1, wherein the subjecting comprises first subjecting the blank to rolling under a roughly constant load for a number of passes until the at least one tool reaches a first chosen position, and second subjecting the blank to rolling under a roughly constant load for a number of passes until the at least one tool reaches a second chosen position.

29. The method of claim 1, wherein the subjecting comprises first subjecting the blank to rolling under a load for a number of passes until the at least one tool reaches a first chosen position, and second subjecting the blank to rolling under a roughly constant load for a number of passes until the at least one tool reaches a second chosen position.

30. A method of cold forming a press sintered material part, comprising:

moving at least one tool towards the part; and subjecting the part to controlled rolling under a roughly constant load for a number of passes until the at least one tool reaches a chosen position, wherein the chosen position, the roughly constant load, and the corresponding number of passes, is determined so as to control a surface densification and at least one dimension of the part being rolled.

31. A method of cold forming a press sintered material part, comprising:

moving at least one tool towards the part; and subjecting the part to a first rolling under a first controlled load for a number of passes until the at least one tool reaches a first chosen position, subjecting the part to a second rolling under a roughly constant second controlled load for a number of passes until the at least one tool reaches a second chosen position, wherein the first chosen position, the second chosen position, the roughly constant load, and the corresponding number of passes, is determined so as to control a surface densification and at least one dimension of the part being rolled.

32. A method of cold forming a press sintered material part, comprising:

moving at least one tool towards the part; and subjecting the part to a first rolling under a first controlled increasing load for a number of passes until the at least one tool reaches a first chosen position, subjecting the part to a second rolling under a second controlled increasing load for a number of passes until the at least one tool reaches a second chosen position;

subjecting the part to a third rolling under a controlled roughly constant load for a number of passes until the at least one tool reaches a third chosen position, wherein the first chosen position, the second chosen position, the third chosen position, the first controlled increasing load, the second controlled increasing load, the controlled roughly constant load, and each number of passes, is determined so as to control a surface densification and at least one dimension of the part being rolled.

33. The method of claim 32, wherein the first controlled increasing load increases at a greater rate that the second controlled increasing load.

34. The method of claim 32, wherein the controlled roughly constant load comprises a maximum load.

35. The method of claim 32, wherein each of the first and second controlled increasing loads are applied to the blank for less time that the controlled roughly constant load.

* * * * *